United States Patent [19]

Gross

[11] Patent Number: 4,813,491

[45] Date of Patent: Mar. 21, 1989

[54] TILLAGE POINT

[75] Inventor: Dennis M. Gross, Caldwell, Id.

[73] Assignee: James C. Vail, Caldwell, Id.

[21] Appl. No.: 78,846

[22] Filed: Jul. 28, 1987

[51] Int. Cl.[4] ..... A01B 13/08

[52] U.S. Cl. ..... 172/699; 37/141 T; 37/142 R; 172/713; 172/747; 172/753; 172/771

[58] Field of Search ..... 37/141 R, 141 T, 142 R, 37/142 A; 172/753, 699, 700, 713, 765, 771, 747

[56] References Cited

U.S. PATENT DOCUMENTS

| | | | |
|---|---|---|---|
| 3,085,635 | 4/1963 | Livermore | 37/142 R X |
| 3,305,029 | 2/1967 | Shelton | 37/142 R X |
| 4,136,469 | 1/1979 | Zepf | 37/141 T |
| 4,446,927 | 5/1984 | Robertson | 172/753 |
| 4,510,706 | 4/1985 | Berchem | 37/141 T X |

FOREIGN PATENT DOCUMENTS

| | | | |
|---|---|---|---|
| 1027150 | 2/1978 | Canada | 37/141 T |

*Primary Examiner*—Paul T. Sewell
*Assistant Examiner*—Moshe I. Cohen
*Attorney, Agent, or Firm*—Richard C. Litman

[57] ABSTRACT

A tillage point for attachment to an excavating or earth-moving apparatus includes a tapered point extending below its longitudinal axis and formed by a convex top surface and concave bottom surface when viewed in side elevation. A convex protuberance axially extending along the bottom surface, combined with the tapered point permits enhanced soil penetration with reduced drag and friction.

3 Claims, 3 Drawing Sheets

TILLAGE POINT

BACKGROUND OF THE INVENTION

1. Field of the Invention

This invention relates to an excavating or earthmoving apparatus and, more particularly, is directed to an improved tillage point which is attached to the shank of excavating or earthmoving apparatuses, such as backhoes, dozers, and rippers.

The invention further relates to an improved construction of a tillage point which provides better wear and heat resistance and easier penetration into the ground or soil, thereby reducing the amount of drag and friction exerted against the excavating or earthmoving apparatus.

The invention can be used on a variety of excavating and earthmoving apparatuses and is very cost effective due to its ease of operation and increased life. Both of these apparatuses are described more fully herein, along with the method of construction.

2. DESCRIPTION OF THE PRIOR ART

Various prior art tillage points used in earthmoving devices, as well as the apparatuses and methods of their construction in general, are known and are found to be exemplary of the U.S. prior art. They are:

| U.S. Pat. No. | Inventor |
|---|---|
| 1,488,398 | W. H. Kline |
| 1,927,818 | M. M. Brodersen |
| 2,738,602 | C. R. Meeks |
| 2,932,100 | G. L. Goethe |
| 3,063,176 | D. S. Larson |
| 3,305,029 | D. L. Shelton |
| 3,326,302 | H. H. Washband et al |
| 3,708,895 | N. N. Griffith et al |
| 3,729,845 | J. S. Flippin |
| 3,774,324 | G. Y. Lafand |
| 3,959,901 | G. R. Klett |
| 3,970,445 | P. Gale et al |
| 4,028,823 | G. Edwards et al |
| 4,037,337 | C. W. Hemphill |
| 4,103,442 | H. R. Zepf |
| 4,136,469 | H. R. Zepf |
| 4,182,058 | A. Poncin |
| 4,446,927 | F. E. Robertson |

U.S. Pat. No. 1,488,398, issued to Kline, discloses a plow point which is attached and detached to a plow share. Although it is used in an earthmoving apparatus, it has a very limited application.

U.S. Pat. No. 1,927,818, issued to Brodersen, discloses a ripper tooth for use in earth, rock, and especially road working tools and comprises a penetrating edge constructed of a material having a greater resistance to wear than the material of the body of the ripper tooth. Thus the body would wear out faster and the invention is more costly.

U.S. Pat. No. 2,738,602, issued to Meeks, discloses a replacement point for the teeth of buckets used in earthmoving equipment and comprises a pyramidical body which is welded to the bucket teeth.

U.S. Pat. No. 2,932,100, issued to Goethe, discloses a land clearing and brush raking attachment for tractor type vehicles.

U.S. Pat. No. 3,063,176, issued to Larson, discloses a hard, replaceable-ripper tip used on the teeth of earthmoving apparatuses. It comprises a blade that is secured to the blade housing by a weld and a retaining pin that secures the blade housing to the shank of the earthmoving vehicle. This device differs from the present invention in that the Larson patent uses a blade that has a very blunt edge and uses a weld that secures it to the blade housing, as opposed to having a solid cast as the present invention does.

U.S. Pat. No. 3,774,324, issued to Lafand, discloses a replaceable two-part digger tooth for earth moving shovels, diggers, and the like. The point of the tooth is held onto the shank by two pins. However, as in the Larson patent, the Lafand patent uses a very blunt edge.

U.S. Pat. No. 3,970,445, issued to Gale et al, discloses a wear resistant alloy comprising boron, chromium, and iron having maximum hardness for a given composition and produced by rapidly cooling and solidifying spheroidal particles of a molten alloy mixture. This material is used in a highly abrasive environment or ground engaging tool, such as ripper tips, bucket teeth, and cutting edges of various types of earthworking machines. Although the Gale patent does disclose usage of a chromium alloy, it does not disclose the unique shape of the present invention.

These patents or known prior uses all teach and disclose various types of teeth used on earthmoving apparatuses of sorts and of various manufacturers, and the like, as well as methods of their construction. However, none of them, whether taken singly or in combination, discloses the specific details of the combination of the invention in such a way as to bear upon the claims of the present invention.

SUMMARY OF THE INVENTION

An object, advantage, and feature of the invention is to provide a novel construction for a tillage point that is easy-to-operate, cost effective, and lends itself for use with excavating or earthmoving apparatuses, such as rippers, backhoes, and dozers.

Another object of the invention is directed further to a tillage point that is attached to the shank of an excavating or earthmoving apparatus, providing for easy penetration of the shank into the ground or soil.

Another object of the invention is to provide a novel and improved construction of a tillage point, preferably containing 22 to 35 percent chromium alloy, which makes it extremely wear and heat resistant. This is a substantial improvement over existing devices, whereby they would wear out 5 to 10 times faster than the present invention.

Another object of the invention is to provide a novel and improved construction of a tillage point, whereby means are incorporated to vary cavity size and hole placement to accommodate different shank sizes and applications.

These, together with other objects and advantages of the invention, reside in the details of the process and operation thereof, as is more fully hereinafter described and claimed. References are made to drawings forming a part hereof, wherein like numerals refer to like parts throughout.

DESCRIPTION OF THE PREFERRED EMBODIMENT

Figure 1:
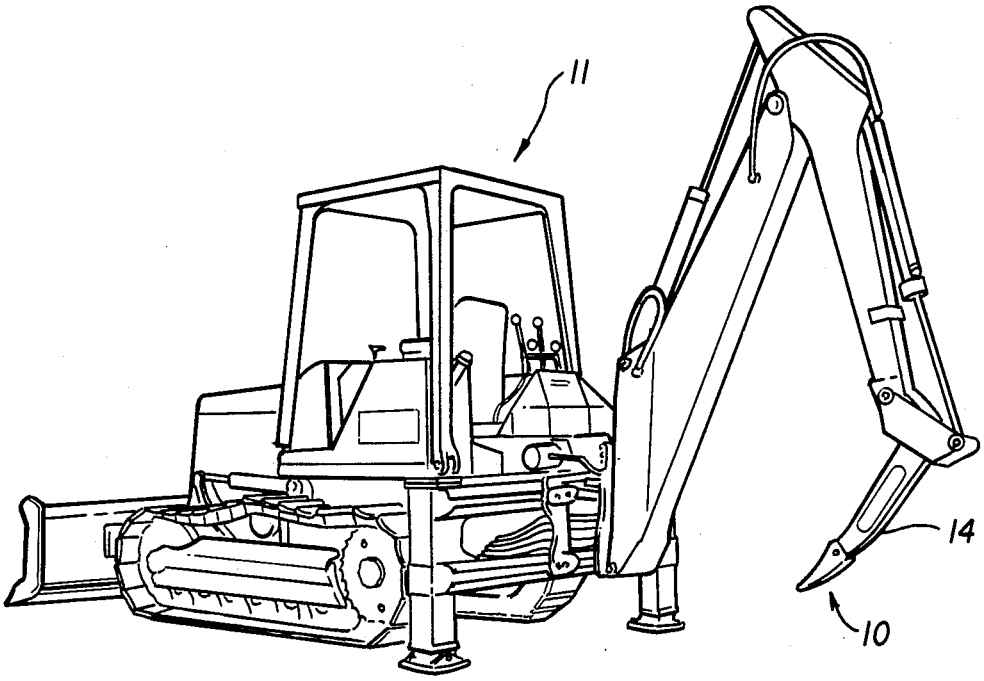
FIG. 1 is an exploded perspective view, illustrating a typical construction of the tillage point according to a preferred embodiment and best mode of the present invention.
Figure 3:
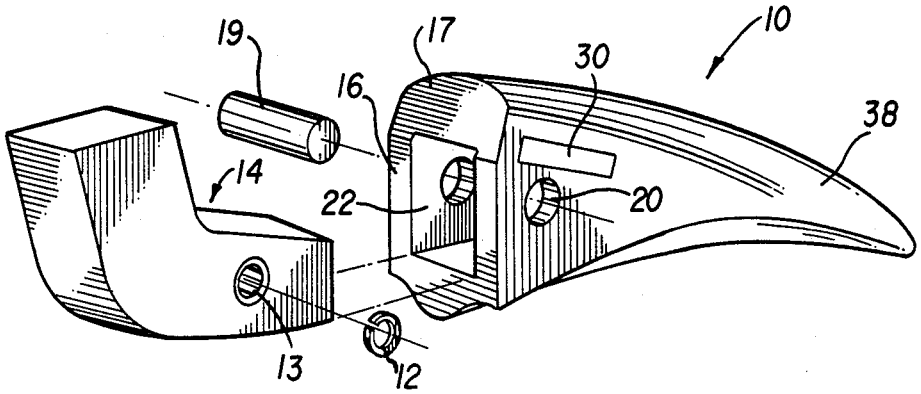
FIG. 3 is a perspective view of the tillage point, illustrating the parts breakdown thereof.

Referring now to the drawings, there is shown in FIG. 3 an exploded perspective view of a tillage point 10 and a shank 14 of a ripper, dozer, backhoe, or other earthmoving apparatus 11 such as shown in FIG. 1. The tillage point 10 is firmly attached to the shank 14 by sliding the shank 14 into the cavity 22 of the tillage point 10. The tillage point 10 may then be secured by inserting a roll pin 19 (a bolt or like means could also be used) through the bore 20 of the tillage point 10, through bore 13 of the shank 14 and, if a bolt is used, by securing it with a lock washer 12 or nut.

Figure 2:
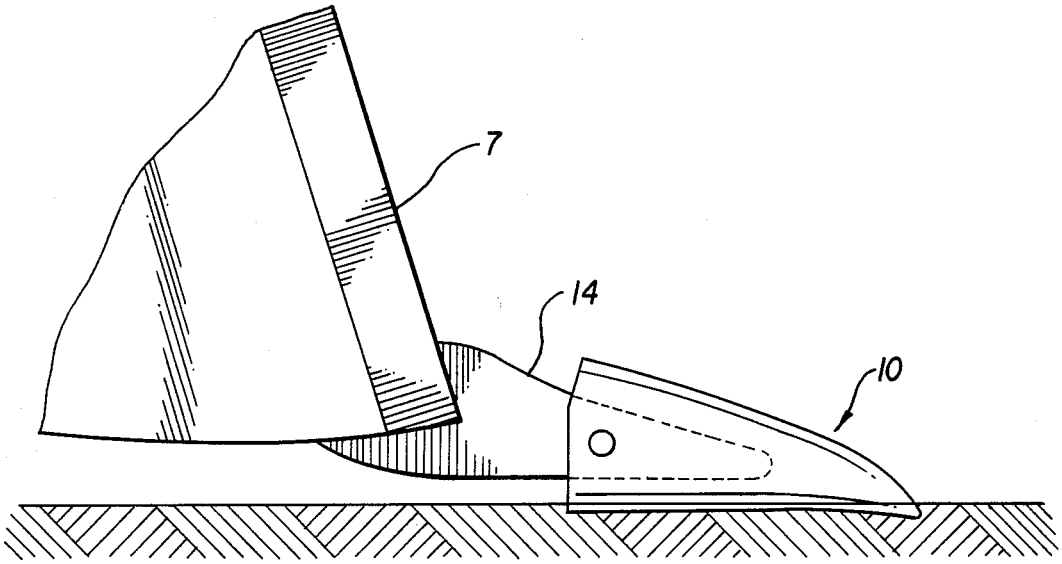
FIG. 2 is a side view of the tillage point according to a preferred embodiment and best mode of the present invention.

FIG. 2 is a side view of the tillage point in use when attached to one of the adaptable earthmoving apparatuses when used with a front-loader bucket 7.

Figure 4:
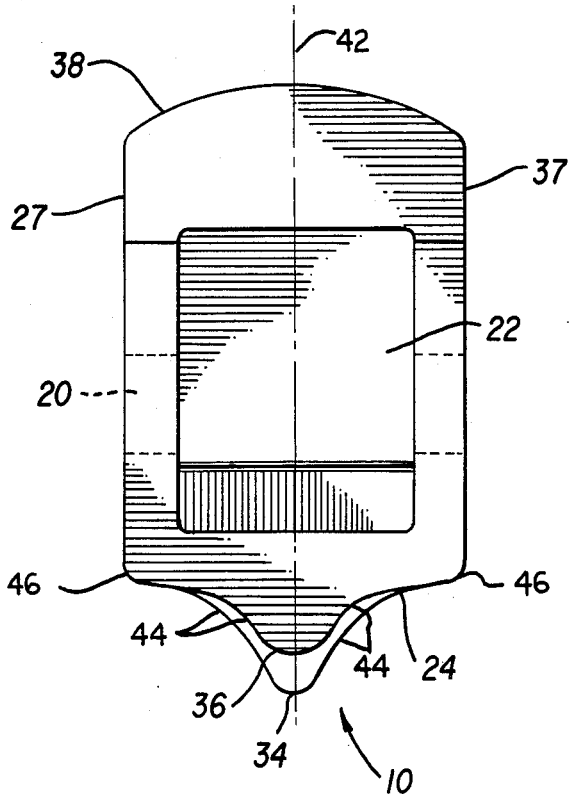
FIG. 4 is an end view of the tillage point.

The tillage point 10 generally configured as a tooth with a plane of symmetry 42, as shown in FIGS. 3 and 4, comprises an end surface 16 which is generally rectangular in shape and contains the cavity 22 adapted to house the shank 14. The end surface 16 has a forwardly tapered uppermost end 17 that joins the top surface 38. The inclined end 17 is tapered approximately 24 degrees and provides a means to compensate for upward movement of the tillage point 10 while mounted on the shank 14 of FIG. 3 during operation of the earthmoving apparatus.

The bottom surface 24 is generally V-shaped and has a convex channel 36 of approximately 0.75-inch radius extending therein. The bottom surface 24 is longitudinally concave, with a downward curvature at its most forward end 34.

The forward point 34 is approximately 0.375-inch in radius and constructed by the convergence of the top surface 38, bottom surface 24, and side surfaces 37, 27 at their most forward ends. Because of the slight curvature of the top, bottom, front, and back surfaces at their most forward ends, the point 34 approximately extends 0.375-inch below the bottom surface 24. This unique construction and shape provides easier penetration into the soil, thus reducing drag and friction and thereby increasing the life of the earthmoving apparatus.

Referring to FIGS. 3 through 6, it can be seen that the two side surfaces 27 and 37 are nearly identical to one another—the only difference being that the right side surface 37 has a generally rectangular groove with rounded ends therein that houses a name plate 30 to identify the size of the tillage point 10. The two side surfaces 27 and 37 of the tillage point are both generally triangular in shape and include a 1-inch diameter bore 20 therethrough.

The tillage point 10 is preferably constructed of a solid cast of chromium alloy. The chromium content may vary between 22 to 35 percent by weight, contingent upon soil conditions. This will provide a highly wear and heat resistant material which increases the reliability of the tillage point 10 and also makes it more cost effective. The cavity 22 and the bores 20 can be varied in size and placement, without changing the overall shape of the tillage point 10, to accommodate different sized shanks 14 and different applications.

Figure 6:
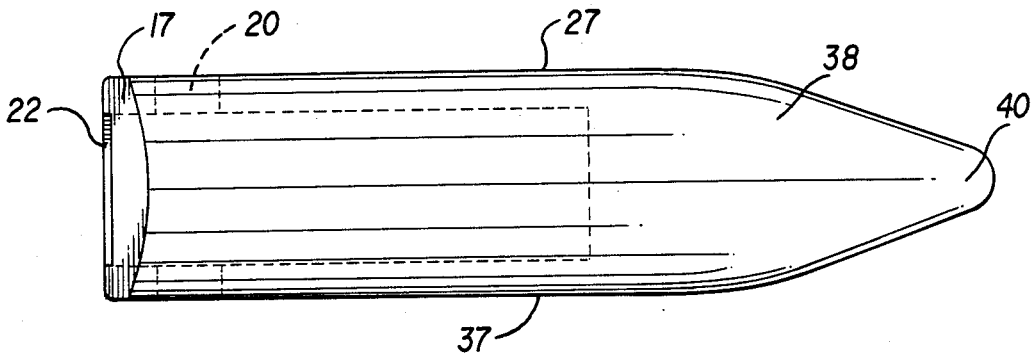
FIG. 6 is a plan view of the tillage point.

FIG. 6 shows that the top surface 38 is generally V-shaped and has a rounded vertex 40 of approximately 0.75-inch radius. The top surface 38 is of slight curvature in vertical cross-section and rearwardly joins to the tapered end 17 of end surface 16. It can also be seen in FIG. 3 that the top surface 38 has a downward curvature near its forward end.

Figure 5:
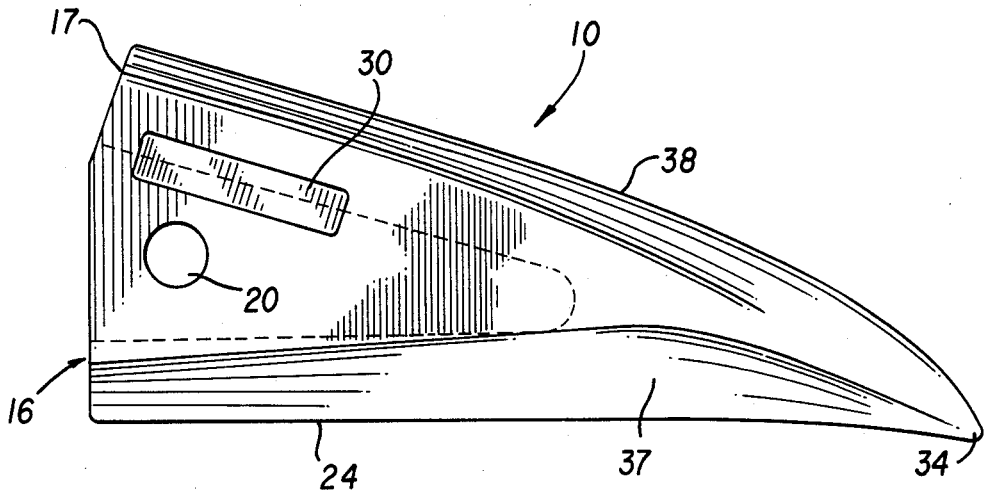
FIG. 5 is a side view of the tillage point, showing the front surface, nameplate, and bore.

In FIG. 4 is shown the plane of symmetry 42 and in FIGS. 3, 4 and 5 is shown the general form of the bottom surface 24, 34 and 36. In FIG. 4 is shown a central portion of the shape of the bottom surface being of a convex spinal contour 34,36 about the plane of symmetry 42 flanked by two concave contours at 44 joined inflectively to said convex spinal contour. The bottom surface has a continuous change of curvature throughout the bottom surface up to the limbs 46.

The foregoing is considered illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A tillage point for attachment to a shank of polygonal cross-section of a backhoe, ripper, dozer or other earthmoving apparatus;

a body generally configured as a tooth with a plane of symmetry;

side surfaces of said body being substantially vertical surfaces joined to a symmetrical convex top surface and bottom surface of a smoothly curved symmetrical shape, said bottom surface joined to said side surfaces at limbs of said symmetrical shape and having a continuous change of curvature throughout said bottom surface to said limbs;

a central portion of said shape being of a convex spinal contour about the plane of symmetry flanked by two concave contours joined inflectively to said convex spinal contour;

said body having an end surface provided with cavity of polygonal cross-section therein adapted to complementarily receive said shank; and removable fastening means engaging said body side surfaces and said shank when disposed therein to be removably secured and assembled therebetween.

2. A tillage point as set forth in claim 1, wherein the material of the body comprises a solid cast, including 22 to 35 percent by weight chromium alloy whereby, said chromium alloy content provides a highly wear and heat resistant material.

3. A tillage point as set forth in claim 1 including an end surface on said body adjacent said shank and having an uppermost forward taper to compensate for movement of said tillage point while mounted on said shank during operation.

* * * * *